US009168628B2

(12) United States Patent
Schneider

(10) Patent No.: US 9,168,628 B2
(45) Date of Patent: Oct. 27, 2015

(54) DEVICE FOR BLOCKING A LENS

(71) Applicant: Schneider GmbH & Co. KG, Fronhausen (DE)

(72) Inventor: Gunter Schneider, Marburg (DE)

(73) Assignee: Schneider GmbH & Co, KG, Fronhausen (DE)

( * ) Notice: Subject to any disclaimer, the term of this patent is extended or adjusted under 35 U.S.C. 154(b) by 463 days.

(21) Appl. No.: 13/683,349

(22) Filed: Nov. 21, 2012

(65) Prior Publication Data

US 2014/0137383 A1 May 22, 2014

(51) Int. Cl.
*B24B 13/005* (2006.01)
*B24B 9/14* (2006.01)

(52) U.S. Cl.
CPC ..... *B24B 13/005* (2013.01); *B24B 9/146* (2013.01); *B24B 13/0057* (2013.01); *Y10T 29/49817* (2015.01)

(58) Field of Classification Search
CPC .. B24B 9/146; B24B 13/005; B24B 13/0052; B24B 13/0055; B24B 13/0057
See application file for complete search history.

(56) References Cited

U.S. PATENT DOCUMENTS

| | | | | | |
|---|---|---|---|---|---|
| 1,455,438 | A * | 5/1923 | Hill | 451/384 |
| 3,091,062 | A * | 5/1963 | Suddarth | 451/460 |
| 3,866,667 | A * | 2/1975 | Knight | 164/334 |
| 5,005,633 | A * | 4/1991 | Mathews et al. | 164/334 |
| 5,291,692 | A * | 3/1994 | Takahashi et al. | 451/388 |
| 5,785,580 | A * | 7/1998 | Cook | 451/42 |
| 7,028,595 | B2 * | 4/2006 | Ben-Menachem et al. | 82/1.3 |
| 7,059,037 | B2 * | 6/2006 | Bergandy et al. | 29/799 |
| 7,189,148 | B2 * | 3/2007 | Toyoshima et al. | 451/42 |
| 8,733,930 | B2 * | 5/2014 | Felten et al. | 351/159.73 |
| 2008/0051017 | A1 * | 2/2008 | Jiang et al. | 451/384 |
| 2011/0031637 | A1 | 2/2011 | Felten et al. | |
| 2011/0096290 | A1 | 4/2011 | Schneider et al. | |

FOREIGN PATENT DOCUMENTS

WO 2011/054665 A1 5/2011

* cited by examiner

*Primary Examiner* — Timothy V Eley
(74) *Attorney, Agent, or Firm* — Roberts Mlotkowski Safran & Cole, PC

(57) ABSTRACT

A device and a method for blocking of an optical lens and to release the blocked lens by an expelling pulse being applied off-center to a block ring which is assigned to the lens.

30 Claims, 1 Drawing Sheet

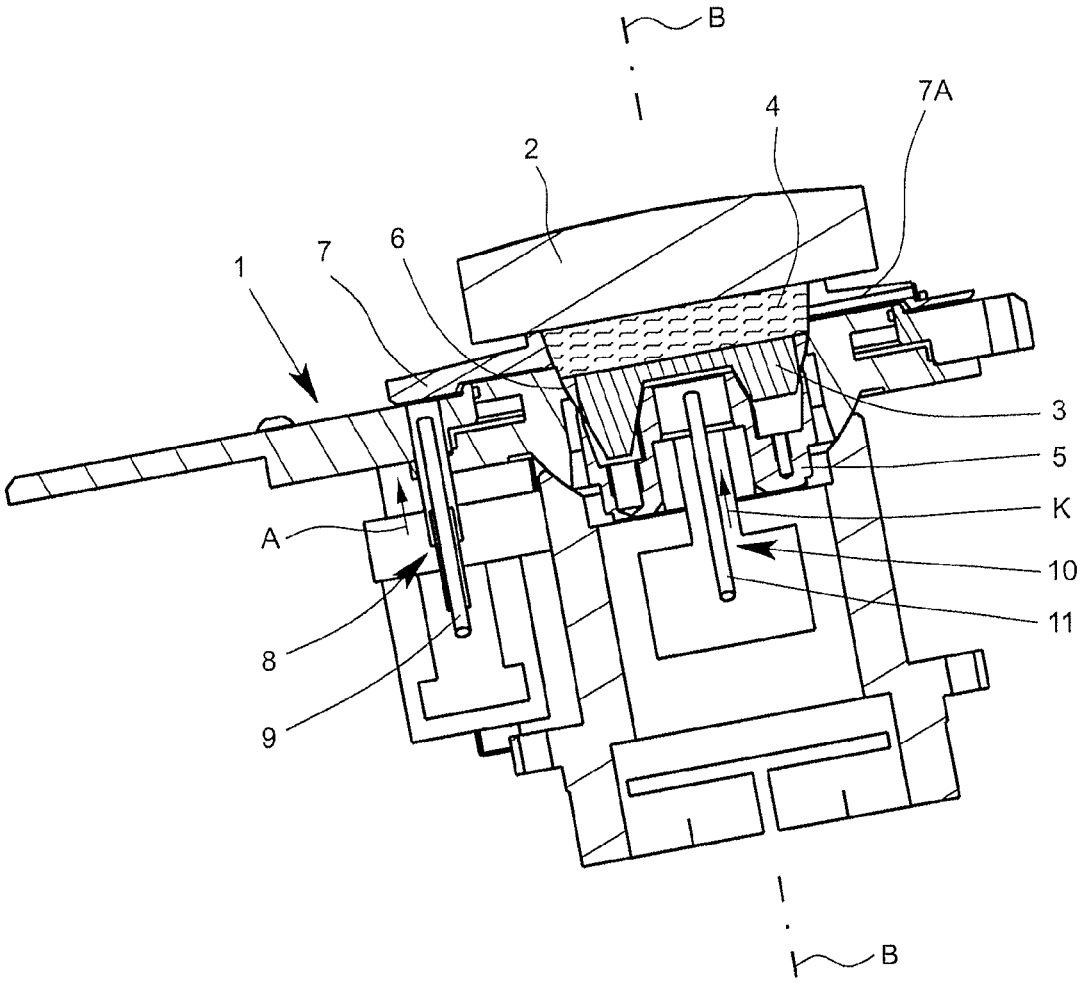
B
7A
4
2
6
7
1
3
5
K
A
10
11
8
9
B

DEVICE FOR BLOCKING A LENS

BACKGROUND OF THE INVENTION

1. Field of the Invention

This invention relates to a device for blocking of an optical lens and a method for blocking of an optical lens.

2. Description of Related Art

An optical lens, for example, for eyeglasses, should have certain optical properties. The associated desired optical data of the lens are determined for example, by an optician. These data comprise for example, the specification of the diopters, data on sphere and cylinder, on the pantoscopic angle, etc. Furthermore, these desired optical data can also contain the distance and/or the location to an assigned eye, especially with installation into a certain eyeglass frame, therefore, for example, the pantoscopic angle, facial shape angle and the lens tilt angle, pupil distance, etc.

In the past, lenses with predetermined optical data, for example, with diopters which were available in different stages, were used. However, increasingly lenses which have the individualized optical data desired at the time and the associated optical properties are being used. These lenses are then machined or produced depending on the respectively desired optical data, the lenses being machined especially by cutting, preferably by turning and/or milling. For this purpose the lenses are clamped, their being first blocked, as explained below.

German Patent Application DE 10 2008 022 660 A1 discloses a method for machining of a lens, the lens to be worked being temporarily fastened (blocked) on a so-called block piece as a holder. The lens is joined to the block piece, especially by means of a block material, during the blocking. Then, the block piece is ejected by means of a centrally acting ejector. The block piece can then be clamped in order to work the lens.

This invention relates to the blocking of a lens. "Blocking" is defined as the temporary joining of the lens to the assigned block piece, especially by means of a block material. The block piece therefore especially forms a holder, preferably for later machining of the lens.

International Patent Application Publication WO 2011/054665 A1 relates to deblocking—therefore the release—of the block material from a lens. This invention conversely relates to the release of the block from the device for blocking. However, in the case of the present invention, releasing of the lens or a lens blank from the block material should not take place; rather the block composed of the lens or lens blank, block material and block piece will remain altogether joined in the device according to the invention and the method according to the invention.

SUMMARY OF THE INVENTION

The object of this invention is to devise a device and a method for blocking of an optical lens, the delivery of the blocked lens and especially the release from a block means, such as a block ring, being simplified or facilitated.

One aspect of this invention is that an expelling device acts directly or indirectly off-center on a blocked lens and at least one expelling pulse is applied off-center to the blocked lens directly or indirectly. In this way, a release of the blocked lens together with the assigned block piece or from a device according to the invention can be achieved, facilitated or supported.

Especially preferably, the expelling device or the expelling pulse acts only indirectly on the lens, especially preferably on a block material which connects a check means for the lens to the block piece. The check means is especially a block ring or the like. In this way, a release of the check means or block ring from the blocked lens or the block material can be facilitated or supported.

According to a second aspect of this invention, which can also be independently implemented, preferably a sequence of expelling pulses is produced which act directly or indirectly on the blocked lens. In this way, especially vibration or oscillation is produced. Thus, in turn, the release of the blocked lens from or out of the device for blocking can be achieved, facilitated or supported. In particular, in this way, the loosening or release of the check means or block ring from the blocked lens or the block material can be achieved or supported in this way.

According to a third aspect of this invention which can also be independently implemented, preferably in addition to the pushing pulse, also an ejector force is applied to the block piece, especially centrally. The ejector force is preferably generated by an ejector device which can be actuated separately from the pushing device. Thus, a release and removal of the blocked lens together with the assigned block piece are greatly simplified or supported.

According to another aspect, the release and/or ejection take place by action of at least one expelling pulse and/or an ejector force in different regions or at different sites. Especially preferably, there are both an expelling device and also an ejector device. Thus, a release and removal of the blocked lens together with the assigned block piece are greatly simplified or supported.

The approach according to the invention and the following indicated aspects of this invention allow improved release and/or removal of the blocked lens, especially even if, for blocking purposes, a block material is used which adheres especially well, especially more strongly than alloys which had conventionally been used to date.

Individual of the aforementioned and following aspects and features of this invention can be optionally combined with one another, but also can be implemented independently of one another.

Other aspects, features, advantages and properties of this invention will become apparent from the following description of a preferred exemplary embodiment with reference to the accompanying drawings.

BRIEF DESCRIPTION OF THE DRAWINGS

The sole FIGURE is a schematic view of a device according to the invention with a blocked lens.

DETAILED DESCRIPTION OF THE INVENTION

The FIGURE shows in a very schematic section of a device 1 according to the invention for blocking of an optical lens 2. The blocking (temporary joining or attachment) of the lens 2 takes place especially to enable a (later) machining of the lens 2.

The starting point for the formation or machining of an optical lens 2 is a lens blank. It is machined by cutting or some other shaping and machining steps such that it results in a finished optical lens 2 with the desired optical properties. The term "lens" within the framework of this description preferably designates both the lens blank before carrying out the necessary machining steps, and also at the end, the finished lens 2.

The lens 2 or the lens blank is preferably made of plastic. However, fundamentally, some other material which can be suitably worked, optionally also glass or mineral glass, can also be used. When the finished lens 2 is to be used for eyeglasses (not shown), which is preferably the case, the lens 2 of this invention is also called spectacle glass even if the lens 2 possibly is not made of glass.

The device 1 is made for blocking or for joining of the lens 2 to an assigned block piece 3.

In the schematic section, the lens 2 is already joined to the block piece 3. This state joined to the block piece 3 is also called "blocked". The blocking, therefore, temporary attachment of the lens 2 on the block piece 3, and takes place preferably by a block material 4, especially an alloy which melts preferably at low temperature, such as a so-called alloy block material, a resin, an adhesive, a plastic, an adhesive tape or the like.

The device 1 for blocking of the lens 2 in the illustrated example preferably has a bearing part 5 for accommodating or supporting the block piece 3. The bearing part 5 is preferably pivotally mounted in the manner of a spherical cap, in the illustrated example especially in or on a preferably spherical cap-like support 6 of the device 1. But, other designs are also possible.

The lens 2 which is to be blocked with the block piece 3 is held by the device 1 spaced away from the block piece 3 at least in regions so that the block material 4 can fill an intermediate space between the lens 2 and the block piece 3, and in this way, can join these two to one another. Preferably, this intermediate space for the block material 4 is surrounded by a check means of the device 1, especially in order to prevent unwanted flow of the initially liquid block material 4 out of the intermediate space. The indicated check means is made preferably at least essentially annular and is formed especially by a block ring 7. The block ring 7 is preferably made at least essentially in the manner of an annular disk or flange-like.

The check means or the block ring 7 preferably forms a support for the lens 2. In particular, the check means or the block ring 7 adjoins the lens 2 peripherally and/or rests on the device 1 or support 6 or an adjoining plate region.

The check means or the block ring 7 preferably seals between the lens 2, on the one hand, and the device 1, on the other, so that the block material 4 which is preferably first liquid at least when it is added cannot escape.

In the illustrated example the device 1 and the check means or the block ring 7 preferably have a corresponding fill opening 7A for the block material 4 for filling purposes. This fill opening 7A can, however, for example, also be formed in the block piece 3 or through the block piece 3.

In the illustrated example, the fill opening 7A lies preferably at the top or in an upper region, so that the air can escape when the block material 4 is added.

The device 1 or the bearing part 5, the support 6 and/or the block piece 3 can, if necessary, be cooled in order to achieve preferably prompt or more promote cooling, and thus, setting of the block material 4.

The block piece 3 is used especially as a holder of the lens 2 for a later machining of the lens 2. For the later machining of the lens 2, the block piece 3 is clamped into a receiver (not shown), such as a chuck or the like, for example, into a workpiece spindle. Then, the cutting or other shaping of the lens, especially by turning and/or milling, can take place.

Therefore, the blocked lens 2 joined to the block piece 3 forms a unit which is subsequently also called a "block" for short.

After blocking, the block or the blocked lens 2 must be removed. To do this, the block piece 3 must be released from the device 1 or its bearing part 5 and also the blocked lens 2 or the block material 4 or the block must be released from the check means or the block ring 7. The check means or the block ring 7 can be placed loosely on the device 1 or around the support 6, the device 1 or the support 6, on the one hand, and the check means or the block ring 7, on the other, preferably being made such that corresponding coaxial positioning, especially by corresponding axial engagement and/or radially grasping it from behind or in some other way, is achieved or ensured. In the case of the check means or block ring 7 which rests preferably only loosely, a separation of the block ring 7 especially from the block material 4 after setting of the block material 4 must be ensured. This is fundamentally possible since the check means or the block ring 7 has a preferably correspondingly inclined, for example, essentially conical or concave inner surface which enables or facilitates a separation from the adjoining block material 4. But nevertheless, this separation or release can be relatively difficult.

According to the invention, the device 1 has an expelling device 8 for release or supporting the release of the lens 2 blocked relative to the block piece 3, from the device 1 and/or the check means or the block ring 7. The expelling device 8 preferably acts off-center directly or indirectly on the lens 2. In particular, at least one expelling pulse, as indicated by the arrow A, is produced and acts directly or indirectly off-center on the blocked lens 2.

To produce the expelling pulse A, the expelling device 8 preferably has a ram 9 which can be moved accordingly, preferably pneumatically or by compressed air, especially against the force of a reset spring, by a double-acting cylinder arrangement or the like. The expelling device 8 can therefore be actuated or driven preferably pneumatically.

Preferably, the expelling device 8 or the expelling pulse A as already mentioned acts directly or indirectly off-center on the lens 2. Especially preferably, indirect action takes place via the check means or the block ring 7. Especially preferably, the expelling device 8 or its ram 9 or the expelling pulse A acts directly on the check means or the block ring 7, especially preferably on the side facing away from the lens 2 or in the expulsion and/or removal direction.

The expulsion direction, the direction of the pulse and/or the removal direction run preferably transversely, especially perpendicular to the end face of the block piece 3 facing the lens 2 and/or to the side of the lens 2 facing the block piece 3 or a major plane of the lens 2. Alternatively or in addition, the indicated direction runs preferably at least essentially parallel to a clamping or rotation axis of the block piece 3 in the later machining of the lens 2. This axis corresponds to the machining axis B indicated in the FIGURE.

Therefore, the expelling device 8 acts preferably directly on the check means for the lens 2 or the block ring 7, especially in order to loosen or release the check means or the block ring 7 from the lens 2 which has been blocked to the block piece 3 or from the block material 4.

In the illustrated example, the expelling device 8 or the expelling pulse A acts preferably radially outside the lens 2 on the check means or block ring 7 which extends accordingly far radially to the outside. In particular, in a very advantageous manner, vibrations or oscillations can be produced which cause or at least support the desired release of the lens 2 or of the block from the device 1 and/or the check means or block ring 7 from the block or block material 4.

Preferably, the check means or the block ring 7 is made of an at least essentially stable or stiff shape and/or is produced especially preferably from metal.

The expelling device 8 or its ram 9 or the expelling pulse A preferably applies a tilting moment to the lens 2, the block, the block piece 3 and/or the check means or the block ring 7.

The expelling device 8 or the expelling pulse A causes preferably a lifting of the blocked lens 2 or of the block.

According to one aspect of this invention which can also be implemented independently, preferably several expelling pulses A or a sequence of expelling pulses A and/or vibration or oscillation, especially of the check means or block ring 7, can be produced. Preferably, the expelling device 8 is made and/or can be actuated to produce several expelling pulses A or a sequence of expelling pulses A and/or for shaking on the block. Thus, the release of the block or of the blocked lens 2 from the device 1 or its bearing part 5 and/or the release of the check means or block ring 7 from the blocked lens 2 or the block or the block material 4 can be achieved or at least supported.

The several expelling pulses A or sequences of expelling pulses A, fundamentally, for the purposes of the invention, can directly or indirectly act or be applied optionally to the blocked lens 2 or the block, but especially preferably this takes place again off-center and/or indirectly via the check means or the block ring 7.

The device 1 preferably, in addition to the expelling device 8, has an ejector device 10 in order to additionally apply an ejector force as indicated by the arrow K in the FIGURE, to the block piece 3 and/or centrally to the blocked lens 2 or the block. To produce the ejector force K, the ejector device 10 preferably has a ram 11 which can be moved accordingly, linearly or back and forth. Especially preferably, the ejector device 10 or its ram 11 can be moved or actuated pneumatically, for example, against the force of a reset spring and/or by a double-acting cylinder or the like.

It is noted that the expelling device 8 and/or the ejector device 10 can also be driven or actuated electrically or electromagnetically, if necessary.

The direction of the ejector force K or the direction of movement of the ram 11 runs preferably at least essentially parallel to the expelling pulse A and/or at least essentially parallel to or along the machining axis B.

The ejector device 10 or ejector force K is preferably applied from the side facing away from the lens 2 to the blocked lens 2 or the block or the block piece 3, especially through a central recess in the device 1 or in its bearing part 5. However, other designs are also possible.

Especially preferably, at least one ejection pulse A and then subsequently the ejector force K is applied. Therefore, the expelling device 8 is preferably actuated first or prior to the ejector device 10. However, the two devices 8, 10 can also be actuated or operated at the same time, if necessary.

For example, it is also possible for first a sequence of expelling pulses A to be applied off-center to the blocked lens 2 or the check means or the block ring 7, and then, during the sequence, in addition, the ejector force K is applied especially centrally in order to finally raise the block or the blocked lens off the device 1.

What is claimed is:

1. A device for blocking of an optical lens, comprising:
a block piece,
an expelling device for releasing or supporting releasing of a lens blocked with the block piece from the device,
wherein the expelling device is positioned to act on the lens in an off-center manner, and
a limiting means for a block material which joins the lens to the block piece, wherein the expelling device acts on the limiting means to release or loosen the limiting means from the lens blocked with the block piece or from the block material.

2. The device as claimed in claim 1, wherein the limiting means forms a support for the lens during blocking.

3. The device as claimed in claim 1, wherein the expelling device is adapted to produce a sequence of expelling pulses for shaking on a block of the blocked lens joined to the block piece.

4. The device as claimed in claim 1, wherein the device has an ejector device for applying an ejection force to the block piece.

5. The device as claimed in claim 4, wherein the ejector device is adapted for being actuated separately from the expelling device.

6. The device as claimed in claim 1, wherein the limiting means comprises a block ring having an at least essentially annular shape.

7. The device as claimed in claim 4, wherein the ejector device is applied through a central recess in the device.

8. The device as claimed in claim 1, wherein the expelling device has a ram which can be moved to produce an expelling pulse.

9. The device as claimed in claim 1, wherein the expelling device acts directly on the limiting means, preferably on the side facing away from the lens in order to loosen or release the limiting means from the lens blocked to the block piece or from the block material.

10. The device as claimed in claim 1, wherein the expelling device is adapted for producing vibrations or oscillations, which cause or at least support release of the blocked lens joined to the block piece from the device or from the limiting means or of the limiting means from the block material.

11. The device as claimed in claim 1, wherein the limiting means surrounds an intermediate space for the block material in order to prevent unwanted flow of the initially liquid block material out of the intermediate space.

12. The device as claimed in claim 1, wherein the limiting means seals between the lens and the device, so that the block material, which is preferably first liquid at least when it is added, cannot escape.

13. The device as claimed in claim 1, wherein the limiting means or the block piece has a fill opening for the block material for filling purposes.

14. A device for blocking of an optical lens, comprising:
a block piece,
an expelling device for releasing or supporting releasing of a lens blocked with the block piece from the device,
wherein the expelling device is adapted to produce a sequence of expelling pulses for at least assisting releasing of the lens blocked with the block piece from the device.

15. The device as claimed in claim 14, further comprising a limiting means for a block material which joins the lens to the block piece, wherein the expelling device acts on the limiting means to release or loosen the limiting means from the lens blocked with the block piece or from the block material.

16. The device as claimed in claim 15, wherein the limiting means forms a support for the lens during blocking.

17. The device as claimed in claim 15, wherein the limiting means comprises a block ring having an at least essentially annular shape.

18. The device as claimed in claim 15, wherein the expelling device acts directly on the limiting means, preferably on the side facing away from the lens in order to loosen or release the limiting means from the lens blocked to the block piece or from the block material.

19. The device as claimed in claim 15, wherein the limiting means surrounds an intermediate space for the block material in order to prevent unwanted flow of the initially liquid block material out of the intermediate space.

20. The device as claimed in claim 15, wherein the limiting means seals between the lens and the device, so that the block material, which is preferably first liquid at least when it is added, cannot escape.

21. The device as claimed in claim 15, wherein the limiting means or the block piece has a fill opening for the block material for filling purposes.

22. The device as claimed in claim 14, wherein the expelling device is adapted to produce a sequence expelling pulses for shaking on a block of the blocked lens joined to the block piece.

23. The device as claimed in claim 14, wherein the device has an ejector device for applying an ejection force to the block piece.

24. The device as claimed in claim 23, wherein the ejector device is applied through a central recess in the device.

25. The device as claimed in claim 14, wherein the ejector device is adapted for being actuated separately from the expelling device.

26. The device as claimed in claim 14, wherein the expelling device is adapted for producing vibrations or oscillations, which cause or at least support release of the blocked lens joined to the block piece from the device.

27. The device as claimed in claim 14, wherein the expelling device has a ram which can be moved to produce an expelling pulse.

28. A device for blocking of an optical lens, comprising:

a block piece, an expelling device for releasing or supporting releasing of a lens blocked with the block piece from the device, an ejector device for applying an ejection force to the block piece to raise the blocked lens together with the block piece off the device, wherein the ejector device is adapted for being actuated separately from or after the expelling device.

29. The device as claimed in claim 28, wherein the expelling device is positioned to act on the lens in an off-center manner and the ejector device is applied through a central recess in the device.

30. The device as claimed in claim 28, wherein the expelling device or the ejector device has a ram which can be moved pneumatically.

* * * * *